United States Patent [19]

Aslund et al.

[11] 4,373,012

[45] Feb. 8, 1983

[54] CASINGS AND PRESSED PARTS UTILIZED FOR THE EXTRUSION OF ARTICLES, PARTICULARLY PIPES, AND MANUFACTURING PROCESS OF SUCH CASINGS AND PRESSED PARTS

[75] Inventors: Christer Aslund; Hans Eriksson; Claes Tornberg, all of Torshälla, Sweden

[73] Assignee: Granges Nyby AB, Nybybruk, Sweden

[21] Appl. No.: 195,610

[22] PCT Filed: Oct. 26, 1979

[86] PCT No.: PCT/EP79/00084

§ 371 Date: Jun. 26, 1980

§ 102(e) Date: Jun. 26, 1980

[87] PCT Pub. No.: WO80/00084

PCT Pub. Date: May 1, 1980

[30] Foreign Application Priority Data

Oct. 26, 1978 [DE] Fed. Rep. of Germany ..... 2846658
Oct. 26, 1978 [DE] Fed. Rep. of Germany ..... 2846659

[51] Int. Cl.[3] ..... B22F 3/00

[52] U.S. Cl. ..... 428/558; 425/78; 29/420.5; 29/42.2; 419/1; 419/9; 419/5

[58] Field of Search ..... 29/420.5, 422; 75/200, 75/214, 226, 208 R; 428/558; 425/78

[56] References Cited

U.S. PATENT DOCUMENTS

| | | | |
|---|---|---|---|
| 3,620,059 | 1/1971 | Nilsson | 29/422 |
| 3,832,100 | 8/1974 | Baxendale | 425/78 |
| 4,131,463 | 12/1978 | DePierre | 428/558 |
| 4,143,208 | 3/1979 | Aslund | 75/208 R |

*Primary Examiner*—Brooks H. Hunt
*Attorney, Agent, or Firm*—Antonelli, Terry & Wands

[57] ABSTRACT

This invention relates to a capsule for pressings pressed by isostatic pressure and to these pressings used for extruding metallic objects, particularly tubes, of stainless steel, the outer and inner wall of the capsule consisting of thin-walled sheet metal, and at least the outer wall having substantially the same strength properties in the axial direction along its circumference and particularly consisting of a spiral-welded tube, and preferably at least on the front end of the capsule an insert being provided, which consists of one or more pieces of a ductile solid material or a ductile material pressed from powder. The invention further relates to a process for the production of such capsules and pressings and to a process for extruding tubes and to the tubes obtained according to this process.

21 Claims, 4 Drawing Figures

CASINGS AND PRESSED PARTS UTILIZED FOR THE EXTRUSION OF ARTICLES, PARTICULARLY PIPES, AND MANUFACTURING PROCESS OF SUCH CASINGS AND PRESSED PARTS

This invention relates to a further development of the process for the production of stainless tubes described in German printed application DE-AS No. 24 19 014, corresponding to U.S. Pat. No. 4,143,208.

The German printed application DE-AS No. 24 19 014 and the corresponding U.S. patent relate to a process for the production of tubes of stainless steel having a uniform structure, uniform physical and chemical properties and good further processing properties, in which powder-form steel of the type in question is introduced into metallic capsules; the capsules are closed and compressed by a pressure acting on all sides thereof and the pressing obtained is extruded into tubes, steel powder of predominantly spherical particles produced by sputtering melt in an inert gas atmosphere being used and the capsules used being thin-walled capsules of a ductile metal having a maximum wall thickness corresponding to approximately 5% of the external diameter of the capsule; the density of the steel powder introduced into the capsule is increased to between about 60 and 70% of the theoretical density by vibration and/or ultrasound; the density of the steel powder is increased to at least 80% and preferably to between 80% and 93% of the theoretical density by isostatic cold pressing of the capsule under a pressure of at least 1500 bars; the pressing is heated and subsequently hot-extruded, preferably at temperatures of at least about 1200° C., to form the required semi-finished product.

According to the German printed application DE-AS No. 24 19 014 it can be of advantage to evacuate the metallic capsules filled with the steel powder before they are closed and/or to fill them with a gas, particularly an inert gas, for example argon.

According to the German printed application DE-AS No. 24 19 014, it is preferred to use metallic capsules of which the wall thickness amounts to less than 3% and more particularly to less than 1% of the external diameter of the capsule, metallic capsules having a wall thickness of from about 0.1 to 5 mm and preferably from about 0.2 to 3 mm being particularly preferred.

According to said German printed application DE-AS No. 24 19 014, it is also possible to produce composite tubes using thin-walled metallic capsules which are separated by one or more concentric partitions into two or more compartments. The predominatly spherical powder particles of the various steel qualities are respectively introduced under vibration into one of these compartments, after which the partitions are removed and the capsules closed, followed by isostatic cold pressing and extrusion at elevated temperature. For extruding the pressings into tubes, glass is normally used as the lubricant. Since stringent demands are imposed on the lubricant in the extrusion of, in particular, stainless steels at elevated temperatures, the pressing is required to have a substantially flat end face so that the lubricant applied to the end face of the pressing in the form of a glass disc is effectively utilised.

It has now been found that the pressings frequently show deviations from the ideal shape and thus lead to difficulties and to rejects in the extrusion process.

The object of the present invention is to produce a capsule and a pressing with which these difficulties of the known embodiments are avoided and with which the number of rejects and of defective products is as low as possible.

According to the invention, this object is achieved in that at least the outer wall of the capsule has substantially the same strength properties in the axial direction over its entire circumference. According to the invention, at least the outer wall of the capsule is preferably formed by a thin-walled, spiral-welded or extruded tube. Forming the outer wall of the capsule in this way affords the advantage that extruded products, particularly tubes, characterised by a considerably reduced number of faults and, hence, rejects are obtained.

It has further been found that extrusion is accompanied by the development of surface faults in the front part of the extruded product on account of the fact that the flow pattern in the transition between the cover and the jacket is seriously disturbed through the disturbing effect of welding. This causes significant losses in the yield of the end product.

Therefore it is a further object of the present invention to increase the yield, i.e. to reduce the percentage of defective products after extrusion.

According to the invention, this object is achieved in that the capsule is constructed in such a way that a funnel-shaped insert is introduced at the end face of the capsule. This construction affords the advantage that the flow properties during extrusion are improved, thereby increasing the yield of stainless material.

According to the invention, the inserts preferably consist of an electrically conductive metal, particularly soft iron or any other inexpensive metal.

According to the invention, the inserts may be in the form of covers which close the capsule at its ends and may be tightly welded to the outer and inner wall of the capsule. Sheet metal inserts in the form of covers may with advantage also be provided between the inserts and the interior of the capsules and may be tightly welded to the outer and inner walls.

According to the invention, it is possible in the case of capsules for the production of pressings for extruding tubes to use funnel-shaped, centrally bored inserts for the front end face of the capsules, the angle 8' between the wall of the central bore for the inner wall of the capsule and the conical outer surface of the funnel-shaped insert amounting to between about 40° and 60°, preferably to between about 40° and 50° and, more particularly, to about 45°.

According to the invention, it can be of advantage in the product of tubes to provide at least on the front end of the capsule a centrally bored annular insert which has a substantially flat end surface and of which the boundary surface between the wall of the central bore and its largest diameter has a substantially arcuate cross-sectional profile, the centre of the arcuate profile lying substantially in the vicinity of the intersecting line between the flat end face and the central bore.

Another significant improvement in the capsules and the pressings and extruded articles, particularly extruded tubes, produced from them, may be obtained in combination with the above-described inserts constructed in accordance with the invention by ensuring that at least the outer wall of the capsule has substantially the same strength properties in the axial direction over its entire circumference. According to the invention, at least the outer wall of the capsule is preferably formed by a thin-walled, spiral-welded or extruded tube. Forming the outer wall of the capsule in this way affords the advantage that extruded products, particularly tubes are, characterised by a considerably reduced number of faults and, hence, rejects are obtained. The insert members can also be pressed from powder material. For this purpose, for example powder obtained by water-atomizing soft iron or water-atomizing low-carbon steel can be used, which powder is subjected to isostatic cold pressing to the desired shape of the afore-mentioned insert members and subsequently to sintering. Cold isostatic pressing of the soft iron powder can take place in a plastic mould, the pressure being preferably selected at least as high if not higher than the pressure for cold isostatic pressing which is applied to the afore-mentioned capsules. By subsequent hot sintering, a dense material can be obtained.

The present invention is applicable to capsules and pressings for extruding objects, particularly tubes, bars or similarly profiled, elongate, dense metallic objects, particularly of stainless steel or highly alloyed nickel steels, particularly heat-resistant steels for heat exchangers, for example highly alloyed nickel steels containing 80% of nickel and 20% of chromium, powder of metal or metal alloys or mixtures thereof or mixtures of powders of metals and/or metal alloys with ceramic powders being introduced into the capsule according to the invention. The powder used is preferably spherical or predominantly spherical powder having a mean particle diameter of preferably less than approximately 1 mm. According to the invention, it is preferred to use spherical powder which has been produced from the required starting material, i.e. the required metal and/or metal alloy, by sputtering in an inert gas atmosphere, perferably an argon atomsphere. Powder particles larger than 1 mm in diameter are preferably separated out, at least to a predominant extent, because argon is in danger of being included into powder particles larger than 1 mm in diameter. An inclusion of argon such as this can occur during sputtering, for example through turbulence. Any inclusion of argon would give rise during extrusion to unfavourable properties of the extruded articles and would lead to inclusion lines.

According to the invention, the capsule used for producing the pressings for the tubes to be extruded is filled with the powder, the density of the powder introduced into the capsule being increased by vibration to between about 60 and 71% of the theoretical density and the frequency of the vibration preferably amounting to at least about 70 Hz and advantageously to between 80 and 100 Hz. By vibration at a frequency of from 80 to 100 Hz, it is possible to obtain a density of from about 68 to 71% of the theoretical density.

After the powder has been introduced and compacted by vibration, the capsule is closed, preferably after evacuation and/or filling with an inert gas. Thereafter the density of the powder is increased to at least 80 to 93% of the theoretical density by isostatic cold pressing under a pressure of at least 4000 bars, preferably under a pressure of from 4200 to 6000 bars and, more particularly, under a pressure of from 4500 to 5000 bars.

Capsules of generally thin sheet steel, preferably about 1 to 2 mm thick sheet steel and, more particularly, approximately 1.5 mm thick sheet steel, have proved to be particularly advantageous. The material used for these capsules is preferably low-carbon soft steel, particularly steel having a carbon content of less than 0.015% and, better still, less than 0.004% in order to prevent the powder from carburising during heat and extrusion.

Under the effect of the pressure applied on all sides during cold isostatic pressing, the capsule is uniformly compressed both in the longitudinal and in the radial direction and thus forms a pressing. This pressing should have no irregularities because this would give rise to difficulties during extrusion, particularly during the extrusion of tubes.

In order to produce a pressing for extruding a tube, an annular capsule is used, the outer wall of this annular capsule being formed by a spiral-welded tube section produced for example from an approximately 1.5 mm thick sheet.

An inner wall, for example in the form of a longitudinally welded tube section, is introduced into the interior of the outer wall, having a smaller diameter than but the same wall thickness as the outer wall. An annular cover is then fixed between the outer wall and the inner wall at one end and the annular space between the two tubes is thus closed at one end. Spherical powder is then introduced into the annular space and compacted to around 68% of the theoretical density by vibration at a frequency of, for example, 80 Hz. A vacuum is then applied and the other end of the annular body is sealed off by a corresponding second cover. Thisis followed by cold isostatic pressing in a liquid, for example water, under a pressure of, for example, 4700 bars. Under the effect of the pressure applied on all sides, a pressing having a density of, for example, 85% of the theoretical density is obtained.

In the capsule according to the invention, the spiral weld seam is required to be as smooth as possible with as little effect as possible on the properties of the sheet steel. Accordingly, the weld seam is preferably smoothed by rolling and/or grinding. The smoothing of the weld seam by rolling may be carried out immediately after welding.

In the case of capsules for the production of tubes, it can be of advantage to produce not only the outer wall, but also the inner wall from a tube which has substantially the same strength properties in the axial direction along its circumference. In this case, the inner wall may consist either of a spiral-welded tube or of an extruded tube. The use of an extruded or spiral-welded tube for the inner wall is particularly advisable in the production of large tubes. In the production of smaller tubes, it is generally sufficient in accordance with the invention for the outer wall of the capsule to be produced from a tube section which has substantially the same strength properties in the axial direction along its circumference.

An embodiment of the invention is described by way of example in the following with reference to the accompanying diagrammatic drawings, wherein.

Figure 1:
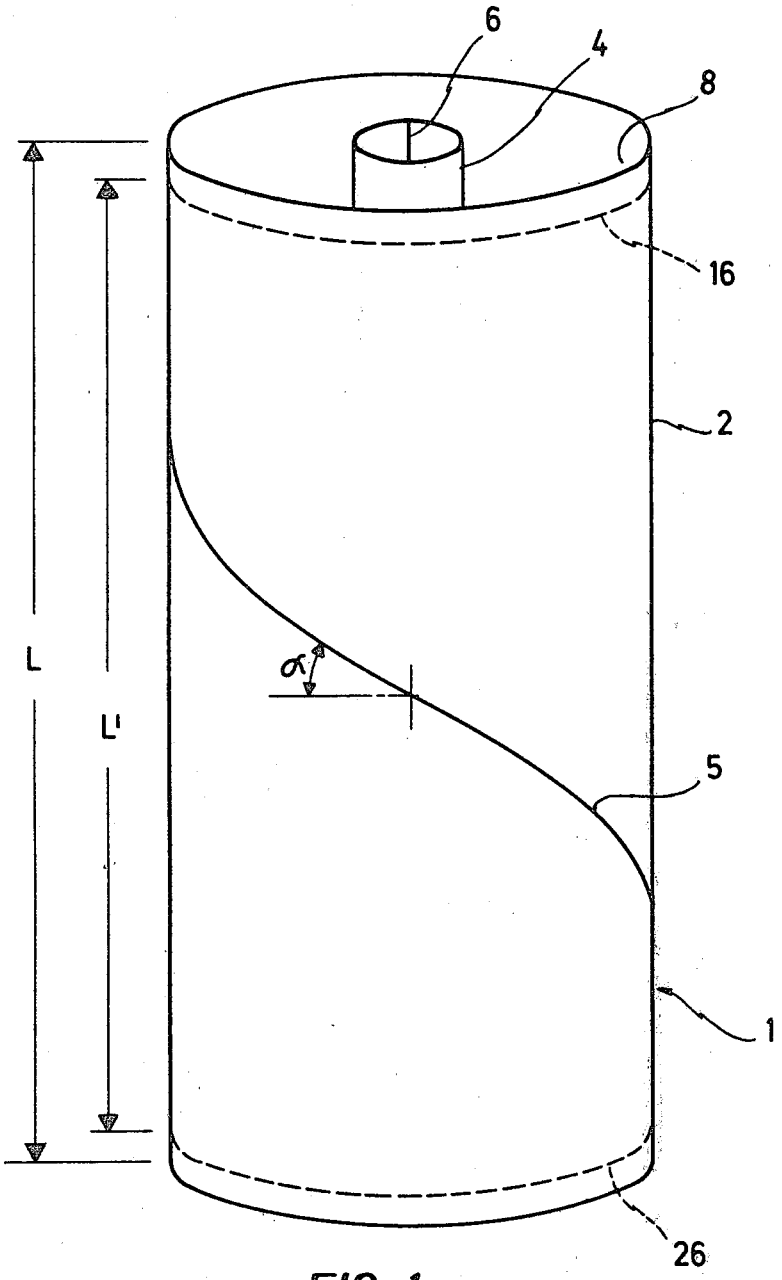
FIG. 1 is an elevation of a capsule open at its upper end.

In FIG. 1, the capsule is generally denoted by the reference 1. The capsule has an outer wall 2 and inner wall 4. The outer wall 2 consists of a spiral-welded tube section having a length L. The weld seam 5 extends spirally over the circumference of the outer wall 2, the spiral having a helix angle $\alpha$ such that the spiral forms approximately one complete turn.

It has been found to be of advantage to arrange the weld seam 5 in such a way that it forms one complete turn between the weld seam 16, which is used to weld the cover (not shown in FIG. 1) of the capsule firmly to the outer wall 2, and the weld seam 26 by means of which the base of the capsule is joined to the outer wall. The distance between the weld seams 16 and 26 is denoted by the reference L' in FIG. 1. This length L' may be regarded as the effective length of the capsule. It is advisable to select the helix angle $\alpha$ of the spiral weld in such a way that $$tg\alpha = L'/(n \cdot \pi \cdot D)$$

where D is the diameter of the capsule and n the number of turns which the spiral weld seam 5 is required to comprise. It has been found to be advisable for n to have a value of 1. However, it may also be of advantage for n to have a value of 2,3,4 or to be equal to a larger whole number.

In one practical example, the outer wall 2 and also the inner wall 4 of the capsule 1 consisted of 1.5 mm thick soft sheet steel having a carbon content of less than 0.004%. The cover, which is not shown in FIG. 1, was welded in along the weld seam 16. To produce the pressing, powder which consisted predominantly of spherical particles having a mean diameter of less than 1 mm and which had been produced from the required starting material, for example stainless steel, by sputtering in an argon atmosphere, was introduced into the capsule. After it had been introduced into the capsule, the powder was compacted to a density of approximately 68% of the theoretical density by vibration at a frequency of 80 Hz. The capsule was then evacuated and closed by means of a cover. The cover was directly joined to the outer wall 2 of the capsule by welding substantially along the line 16 in FIG. 1. In the example in question, the capsule had a length of 600 mm and an external diameter of 150 mm. The internal diameter of the inner wall 4 was approximately 55 mm. The inner wall 4 consisted of a longitudinally welded tube section with a longitudinal weld seam 6. The powder was then compressed to around 85% of the theoretical density by isostatic cold pressing under a pressure of 4700 bars. The pressing thus obtained was extruded into a tube as described in said German printed application DE-AS No. 24 19 014.

Figure 2:
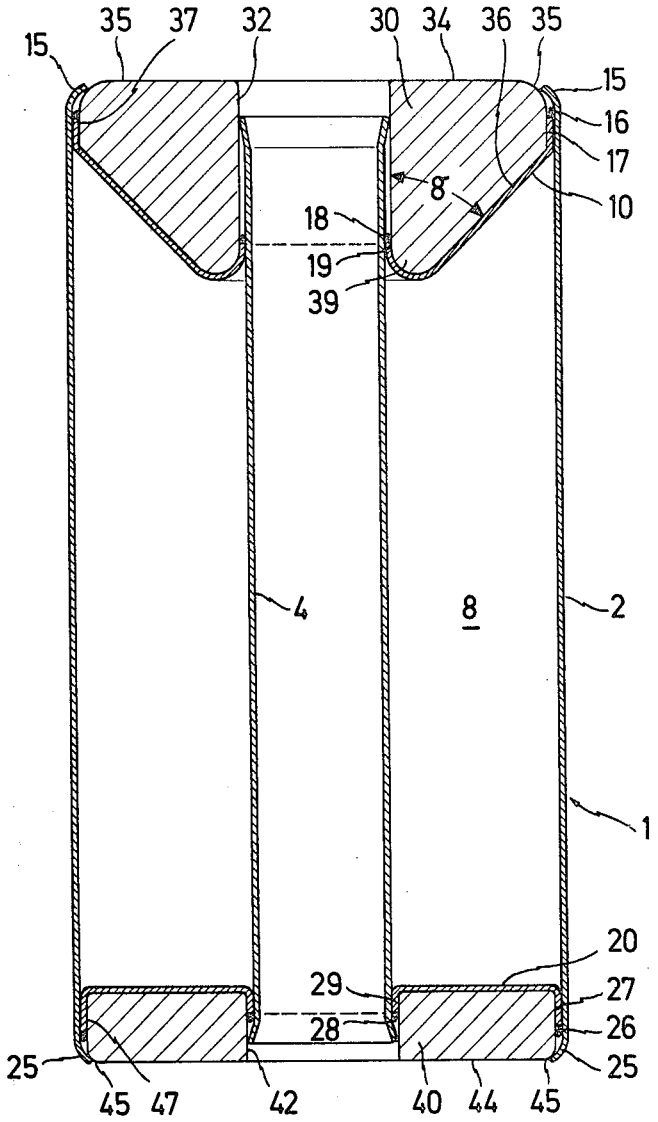
FIG. 2 is a longitudinal section through a modified embodiment of the capsule.

In the embodiment illustrated in FIG. 2 plug-like, inserts 30 and 40 are arranged in the region of the cover 10 and the base 20, forming the front and rear end face, respectively, of the capsule. The front insert 30 is generally conical and comprises a central bore 32 for receiving the inner wall 4 of the capsule. The conical surface 36 of the conical or funnel-shaped insert 30 forms with the wall of the bore 32 an angle 8' which is preferably in the range from about 40° to 60°, advantageously in the range from about 40° to about 50° and, more particularly, of the order of 45°. The insert 30 comprises a substantially flat end face 34. However, it is bevelled or rounded off at its outer edge (at 35) and then comprises a cylindrical section 37 which merges into the conical surface 36. The transition from the conical surface 36 to the wall of the central bore 32 is rounded off at 39. The cover 10 in the form of a sheet-metal insert corresponds exactly in its contour to the adjoining parts of the insert 30. More particularly, the cover 10 comprises along its outer edge a cylindrical section 17 which provides for firm contact between the cover 10 and the outer wall 2, the outer edge of this cylindrical section 17 being joined to the outer wall 2 means of a weld seam 16. In its inner region, too, the cover 10 comprises a short, substantially cylindrical section 19 which is in contact with the inner wall 4 of the capsule and which is tightly welded to the inner wall 4 at 18 by means of a weld seam. The cover 10 also comprises a rounding-off corresponding to the rounding-off 39 of the insert 30.

Arranged at the rear end of the capsule 1 is an insert 40 in the form of a substantially flat plate which comprises a central bore 42 and an outwardly directed end face 44. This plate-like insert 40 is also bevelled or rounded off at its edge (at 45) and comprises an outer cylindrical section 47. The base 20 of the capsule corresponds in shape to the shape of the insert 40 and also comprises an outer cylindrical section 27 and an inner cylindrical section 29. The base 20 is tightly welded to the outer wall 2 and the inner wall 4 by means of weld seams 26 and 28, respectively. The inserts 30 and 40 preferably consist of soft iron or low carbon soft steel.

Figure 3:
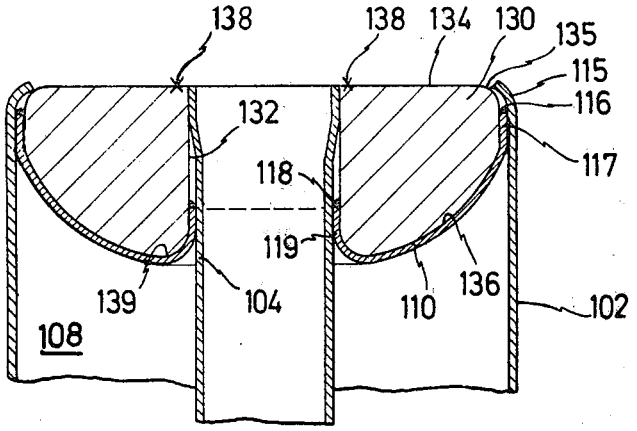
FIGS. 3 and 4 are partial sections through other embodiments.

FIG. 3 shows a modified embodiment of the capsule in which a plug-like insert 130 provided at the front end of the capsule comprises a substantially arcuate cross-sectional profile 136, a flat end face 134 and a central bore 132. The centres of the arcuate cross-sectional profile 136 are situated on a circle substantially in the vicinity of the intersecting line between the flat end face 134 and the wall of the bore 132, i.e. in the region of the front boundary line of the bore 132. This circle is indicated by two crosses at 138 in FIG. 3. The substantially arcuate cross-sectional profile 136 affords the advantage that, during extrusion of the pressing, the insert 130 consisting of soft iron or a similar metal, together with the cover 110, the weld seams 116, 118 and the adjacent parts of the outer wall 102 and the inner wall 104, form the first part of the tube which is cut off or even drops off automatically after extrusion if the connection to the following tube preferably consisting of stainless steel and produced from the powder filling of the capsule lacks sufficient strength. The effect of the substantially arcuate shape of the boundary line 136 of the insert 130 is that the dividing line between the front part of the extruded tube, which accumulates as waste, and the actual tube consisting of high quality stainless steel is clearly defined and is in the form of a separation surface extending substantially perpendicularly of the longitudinal axis of the tube. The cover 110 also comprises a substantially cylindrical section 117 which is welded at 116 to the outer wall 102 of the capsule, and a substantially cylindrical inner section 119 which is in contact with the inner wall 104 and which is tightly welded to the inner wall at 118 by means of an encircling weld seam. The transition from the wall of the central bore 132 to the circular cross-sectional profile 136 is rounded off at 139.

It can also be of advantage for the inserts 30 and 40 to be directly tightly welded to the outer wall 2 and the inner wall 4. In this case, the cover 10 and the base 20 may be omitted. Similarly, the insert shown in FIG. 3 may be directly tightly welded to the outer wall 102 and to the inner wall 104.

In cases where sheet metal inserts are used as cover and base, it may be of advantage to join the inserts 30, 40, 130 to them by spot welding. In many cases, however, it is also sufficient to fix the inserts 30, 40 and 130 through the flanged ends 15, 25 and 115 of the outer wall 2 and 102.

During extrusion, the insert at the front end of the capsule leads to a type of tunnel effect providing it is made of ductile material, for example ductile iron, soft iron, low-alloyed carbon steel or cast iron. The pressure required in the container of the extrusion press for extruding the pressing is reduced where the front insert consists of ductile material which can be made to flow more easily than the powder filling of the pressing. Once the flow process taking place during extrusion has started, it also affects the powder filling, even when the yield point of the powder filling is higher than the yield point of the ductile material of the insert. Accordingly, a type of tunnel effect is obtained.

Moreover, the pressing was also completely straight and, after inductive heating to 1200° C., could be directly extruded to form the required stainless and seamless tube without any need for further machining operations. The front section of the tube consisting of low-alloyed carbon steel was cut off. None of the stainless steel was cut off. By virtue of the fact that the insert is conical, a substantially vertical (relative to the tube axis) parting line between the extruded insert and the stainless steel was obtained in the extruded tube. That part of the tube which consisted of stainless material had a fault-free surface. In this way, the loss of material was reduced to a minimum.

In order to obtain good separation between the front section of the extruded tube, which consists of a low-alloyed carbon steel, and the desired seamless tube of stainless steel, a layer of glass can according to the invention be applied to the surface of the cover 10 or 110 facing the powder filling 8, 108. It can be of advantage for this purpose to heat the cover 10 or 110 and to sprinkle glass powder onto their outer surfaces, the temperature of the insert member being selected so that the glass powder becomes soft and adheres. By such an intermediate layer of glass, the separation between the low-alloyed carbon steel and the stainless steel is made very much easier when the extruded tube is obtained so that the two steel grades are obtained completely separately from each other and without mixing.

Similarly, also the surface of the base 20, which is adjacent to the powder filling 8 on the bottom of the capsule can be provided with a layer of glass facilitating a separation of the stainless steel material and the low-alloyed carbon steel.

The curved or rounded-off insert members 30, 40, and 130 can also be pressed from powder material. For this purpose, for example powder obtained by water-atomizing soft iron or water-atomizing low-carbon steel can be used, which powder is subjected to isostatic cold pressing to the desired shape of the aforementioned insert members and subsequently to sintering. Isostatic cold pressing of the soft iron powder can take place in a plastic mould, the pressure being preferrably selected at least as high if not higher than the pressure for isostatic cold pressing which is applied to the aforementioned capsules. By subsequent hot sintering, a dense material can be obtained. Alternatively or additionally, in this case also a sealing can be obtained at the front end faces 34, 134, and 334 respectively 44 as well as on the circumferential surfaces by applying an outer layer of glass thereon.

Figure 4:
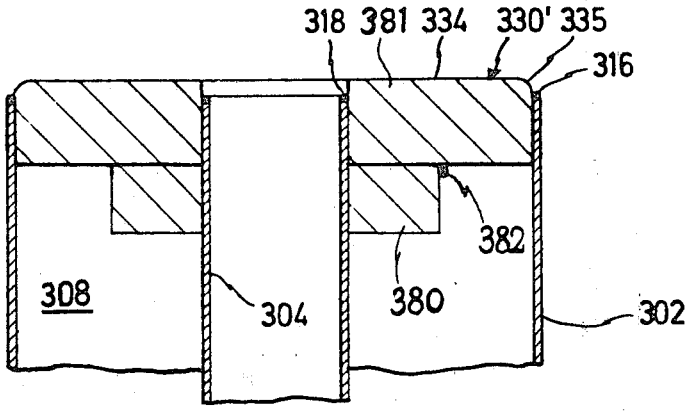

The embodiment according to FIG. 4 corresponds extensively to the embodiment according to FIG. 3. Only the upper insert members have a modified shape. The front insert 330' comprises two rings 380 and 381 held together by several spot weldings 382. Instead of two rings 380, 381, of course three or more rings can also be provided, whereby the outer contour of such rings constitutes an approximation to the ideal contour of the front insert member which is determined by the arcuate cross-section 136 in FIG. 3.

A substantial difference consists in that no sheet metal inserts are provided between the insert 330' and the powder filling 308, but the outer wall 301 at 316 and the inner wall 304 at 318 are directly tightly welded to the insert or its upper ring, respectively. The ring 381 is bevelled or rounded off at 335 similar to the rounding-off 35 of the insert 30 and the rounding-off 135 of the insert 130. In the embodiment according to FIG. 3, the bottom insert, which is not shown, consists of an annular plate which is also directly tightly welded to the outer wall and the inner wall so that a bottom metal sheet can be omitted.

All particulars and features disclosed in the documents, particularly the spatial configuration disclosed, are claimed as being essential to the invention where they are new either individually or in combination in relation to the prior art.

We claim:

1. A capsule having an annular transverse cross section for isostatically producing a pressing for use in the extrusion of dense metallic tubes, said capsule comprising a tubular thin-walled sheet metal container to be filled with a powder and having plug-like inserts for closing each of its opposite ends, wherein at least the insert at the front end of the capsule is formed of ductile material, has a generally annular shape with a central bore, is provided with a substantially flat end face at the front end of the capsule, and has an external diameter which decreases rearwardly from a point of maximum external diameter to a wall defining said central bore, and wherein at least the outer wall of the thin-walled sheet metal container has substantially the same strength properties in the axial direction along its entire circumference.

2. A capsule according to claim 1, wherein the axial strength properties of at least said outer wall are made substantially the same along its entire circumference by said wall having been formed from a strip of sheet metal which is wound into a cylindrical form having a spiral seam and spiral-welded along said seam.

3. A capsule according to claim 2, wherein said plug-like inserts are covered by sheet metal inserts at a side facing the interior of the capsule.

4. A capsule as claimed in claim 3, characterized in that the sheet metal inserts (10, 20) are joined to the outer wall (2) and optionally to the inner wall (4) of the capsule (1) by welds (16, 18, 26, 28).

5. A capsule as claimed in claims 1 or 2, characterised in that the inserts (30, 40) are welded to the outer wall (2) and optionally to the inner wall (4) of the capsule.

6. Capsules as claimed in claim 2, characterised in that the pitch ($\alpha$) of the spiral formed by the weld seam (5) in relation to the length (L) of the capsule (1) is such that the weld seam (5) forms substantially one, two or more complete turns.

7. Capsules as claimed in one of claims 2 or 6, characterized in that the spiral weld seam is smoothed by at least one of rolling and grinding.

8. A capsule according to claim 1, wherein the axial strength properties of at least said outer wall are made substantially the same along its entire circumference by said wall having been formed by extrusion.

9. A capsule according to claim 1 or 2 or 8, wherein said decreasing external diameter forms a conical outer surface.

10. A capsule according to claim 9, wherein an angle of between 40 and 60 degrees is formed between said conical outer surface and said central bore.

11. A capsule according to claim 1 or 2 or 8, wherein said decreasing external diameter forms an outer surface having arcuate corss-sectional profiles.

12. A capsule according to claim 11, wherein the centers of the arcuate cross-sectional profiles of said outer surface lie on a circle formed substantially in the vicinity of an intersecting line between said flat end face and said central bore.

13. A capsule as claimed in claim 2 or 9 or 11, characterized in that the inserts (30, 40) consist of an electrically conductive metal, preferably soft iron.

14. A pressing for the extrusion of tubes, comprising a tubular capsule formed of a tubular thin-walled sheet metal container having inner and outer peripheral walls, preferably low-carbon sheet-steel having a carbon content of less than 0.015 percent and preferably less than 0.004 percent, wherein at least the outer wall of the thin-walled sheet metal container has substantially the same strength properties in the axial direction along its entire circumference, the capsule being filled with powder from the group consisting of metal or metal alloys or mixtures thereof, or mixtures thereof with ceramic powders, which preferably consists of spherical or predominantly spherical inert gas atomized particles, and the density of the powder introduced into the capsule having been increased to at least 80 to 93 percent of the theoretical density by isostatic cold pressing of said capsule, and wherein said capsule is closed at each of opposite ends by a plug-like insert, wherein at least the insert at the front end of the capsule is formed of ductile material, has a generally annular shape with a central bore, is provided with a substantially flat end face at the front end of the capsule, and has an external diameter which decreases rearwardly from a point of maximum external diameter to a wall defining said central bore.

15. A process for producing pressings as claimed in claim 14, wherein at least the insert provided at the front end is made of a ductile metal, for example soft iron, low-carbon steel or cast iron, of which the yield point in a container of an extrusion press is considerably below the yield point of the powder filling of the pressing so that the extrusion process begins under the pressure required for the ductile material of the insert and is transferred by tunnel effect to the powder filling.

16. A pressing according to claim 14, wherein said decreasing external diameter forms a conical outer surface.

17. A pressing according to claim 16, wherein an angle of between 40 and 60 degrees is formed between said conical outer surface and said central bore.

18. A pressing according to claim 14, wherein said decreasing external diameter forms an outer surface having arcuate cross-sectional profiles.

19. A pressing according to claim 18, wherein the centers of the arcuate cross-sectional profiles of said outer surface lie on a circle formed substantially in the vicinity of an intersecting line between said flat end face and said central bore.

20. A process for producing a dense metallic tube, said process comprising the steps of providing a tubular, thin-walled, sheet metal container, said container having an outer and inner peripheral wall, wherein at least the outer wall of the thin-walled sheet metal container has substantially the same strength properties in the axial direction along its entire circumference, providing plug-like inserts for closing the opposite ends of said container, wherein at least the insert at the front end of the capsule is formed of ductile material, has a generally annular shape with a central bore, is provided with a substantially flat end face at the front end of the capsule, and has an external diameter which decreases rearwardly from a point of maximum external diameter to a wall defining said central bore, filling said capsule with a powder selected from the group consisting of metal or metal alloys, or mixtures thereof with ceramic powders, increasing the density of said powder by vibration to between 60 and 70 percent of the theoretical density, sealing said inserts to the opposite ends of said container and further increasing the density of said powder to at least 80 to 93 percent of the theoretical density by isostatic cold pressing to produce a pressing, and extruding said pressing in an extrusion means to form said dense metallic tube.

21. Process according to claim 20, characterized in that for obtaining good lubrication when extruding, glass is used for lubrication, which is placed in form of a glass disc on the front end (34, 134, 334) of the pressing in the container or receiver of the extrusion press, is supplied by means of a bevelled front edge (35, 135, 335) of the front insert (30, 130, 330') and a very precise adaptation of the substantially exactly cylindric external diameter of the pressing to the substantially cylindric internal diameter of the container or receiver of the extrusion press, during the entire extrusion operation, substantially uniformly distributed in the circumferential direction between tool and extruded object.

* * * * *